United States Patent [19]

Rechlicz

[11] 4,331,517

[45] May 25, 1982

[54] METHOD OF PREPARING A CATHODE BY HIGH AND LOW TEMPERATURE ELECTROPLATING OF CATALYTIC AND SACRIFICIAL METALS, AND ELECTRODE PREPARED THEREBY

[75] Inventor: Thomas A. Rechlicz, Corpus Christi, Tex.

[73] Assignee: PPG Industries, Inc., Pittsburgh, Pa.

[21] Appl. No.: 250,499

[22] Filed: Apr. 2, 1981

[51] Int. Cl.[3] ..... C25D 5/48; C25B 11/06; C25B 11/08; C25D 3/56

[52] U.S. Cl. ..... 204/35 R; 204/40; 204/43 R; 204/43 N; 204/43 S; 204/43 T; 204/43 Z; 204/44; 204/291; 204/293; 204/294

[58] Field of Search ..... 204/40, 43 Z, 43 T, 204/43 R, 43 S, 43 N, 44, 291, 293–294, 35 R

[56] References Cited

U.S. PATENT DOCUMENTS

| | | | |
|---|---|---|---|
| 3,272,728 | 9/1966 | Hahndorf | 204/35 |
| 4,104,133 | 1/1978 | Brannan et al. | 204/25 |
| 4,221,643 | 9/1980 | Miles et al. | 204/98 |
| 4,250,004 | 2/1981 | Miles et al. | 204/98 |

OTHER PUBLICATIONS

Malkin et al., "Reduction of Hydrogen Overpotential in a Chlorine Cell", May, 1979.

*Primary Examiner*—R. L. Andrews
*Attorney, Agent, or Firm*—Richard M. Goldman

[57] ABSTRACT

Disclosed is a method of forming a cathode by electroplating a sacrificial metal and a catalytic metal from an electroplating solution onto an electroconductive substrate. Initial electrodeposition is carried out at a high temperature to preferentially electroplate the catalytic metal, the electroplating solution is then cooled, and thereafter the electrodeposition is carried out at a lower temperature to codeposit sacrificial metal and catalytic metal. Also disclosed is an electrode prepared thereby.

28 Claims, No Drawings

METHOD OF PREPARING A CATHODE BY HIGH AND LOW TEMPERATURE ELECTROPLATING OF CATALYTIC AND SACRIFICIAL METALS, AND ELECTRODE PREPARED THEREBY

DESCRIPTION OF THE INVENTION

Alkali metal hydroxide and chlorine are industrially produced by electrolyzing an alkali metal chloride brine, for example an aqueous solution of sodium chloride or an aqueous solution of potassium chloride. The alkali metal chloride solution is fed into the anolyte compartment of an electrolytic cell, a voltage is imposed across the cell, chlorine is evolved at the anode, alkali metal hydroxide is formed in the catholyte liquor, and hydrogen is evolved at the cathode.

The overall anode reaction is:

$$Cl^- \rightarrow \tfrac{1}{2}Cl_2 + e^- \quad (1)$$

while the overall cathode reaction is:

$$H_2O + e^- \rightarrow \tfrac{1}{2}H_2 + OH^- \quad (2)$$

More precisely, the cathode reaction is reported to be:

$$H_2O + e^- \rightarrow H_{ads} + OH^- \quad (3)$$

by which the monoatomic hydrogen is adsorbed onto the surface of the cathode. In alkaline media, the adsorbed hydrogen is reported to be desorbed from the cathode surface according to one of two processes:

$$2H_{ads} \rightarrow H_2, \text{ or} \quad (4)$$

$$H_{ads} + H_2O + e^- \rightarrow H_2 + OH^- \quad (5)$$

The hydrogen desorption step, i.e., reaction (4) or reaction (5), is reported to be the hydrogen overvoltage determining step. That is, it is the rate controlling step and its activation energy bears a relationship to the cathodic hydrogen evolution overvoltage. The hydrogen evolution potential for the overall reaction (2) is on the order of about 1.25 to 1.35 volts measured against a saturated silver-silver chloride reference electrode on an iron cathode in alkaline media. Approximately 0.2 to 0.3 volt represents the hydrogen overvoltage on the iron while 1.07 volt is the equilibrium decomposition voltage versus a silver-silver chloride reference electrode.

Iron, as used herein to characterize cathodes, includes elemental iron such as carbon steels, and alloys of iron with manganese, phosphorus, cobalt, nickel, molybdenum, chromium, canadium, palladium, titanium, zirconium, niobium, tantalum, tungsten, carbon, and the like.

It has now been found that the hydrogen overvoltage may be reduced, for example, to from about 0.01 volt to about 0.20 volt, by utilizing a cathode having a porous catalytic surface prepared by electrodeposition of a sacrificial metal and a catalytic metal, where the electrodeposition is commenced at a first, higher temperature to preferentially electrodeposit the catalytic metal, and continued thereafter, without interrupting electrodeposition or removing the cathode from the electroplating solution, at a second, lower temperature to codeposit sacrificial metal and catalytic metal.

According to a still further exemplification of this invention, it has been found that a particularly desirable electrolytic cell may be provided having an anode, a cathode, and permionic membrane therebetween to separate the anolyte compartment from the catholyte compartment, wherein the cathode is prepared as described herein.

According to a still further exemplification of this invention, it is possible to electrolyze alkali metal halide brines by feeding the alkali metal halide brine to the anolyte compartment, evolving the halogen at the anode, and hydroxyl ion at the cathode, where the cathode is prepared as described herein.

DETAILED DESCRIPTION OF THE INVENTION

Disclosed herein is a method of preparing a cathode by electrodepositing catalytic metal and a sacrificial metal onto an electroconductive substrate by the method of inserting the electroconductive substrate into an electroplating solution containing cations of the catalytic metal, cations of the sacrificial metal, and plating anode means, and passing an electrical current from the plating anode means to the cathode whereby to electrodeposit metal on the electroconductive substrate. The electrodeposition is carried out at a first, elevated temperature whereby to preferentially electrodeposit catalytic metal onto the electroconductive substrate. Thereafter the electrodeposition is commenced at a second, lower temperature whereby to codeposit catalytic metal and sacrificial metal.

The first elevated temperature is high enough to substantially avoid deposition of the sacrificial metal. That is, it is preferably above about 60 degrees Centigrade as will be described more fully herein below. The second, lower temperature is low enough to codeposit sacrificial metal and catalytic metal at a desired rate. Preferably, the second lower temperature is below about 60 degrees Centigrade.

It has been found that catalytic metals and sacrificial metals have different electroplating rates at different temperatures, with catalytic metals, exemplified by nickel, preferentially electroplating at high temperatures, and sacrificial metals, exemplified by zinc, preferentially electroplating at lower temperatures. Moreover, it has been found that the relative rates of electrodeposition of the metals, that is their concentrations in the deposit as compared to their concentrations in the electroplating solution, are a function of the current density, the electrocatalytic metal preferentially electrodepositing at lower current densities and the sacrificial metal preferentially electrodepositing at higher current densities.

It has now been found that a particularly desirable electrolytic cathode may be prepared by commencing electrolysis at a first, higher temperature, and a lower current density and thereafter, without removal of the cathode from the electroplating solution, and, preferably, without interruption of the electroplating current, lowering the temperature of the electroplating solution, either at a constant current density, at an increasing current density or at a decreasing current density, whereby to substantially codeposit the sacrificial metal or metals and catalytic metal or metals.

By substantially codeposit the sacricial metals and catalytic metals it is meant that the deposition of sacrificial metals is high enough that upon activation there is provided a porous surface, while by preferentially electrodepositing catalytic metals it is meant that the electrodeposit of the catalytic metal is such that the amount of sacrificial metal therein is low enough that upon activation the catalytic metal preferentially electrodeposited is substantially free of pores or openings and is substantially impermeable to electrolyte. By a film of preferentially electrodeposited catalytic metal is meant a film containing sufficiently low amounts, if any, of the sacrificial metal, to prevent dissolution and pore formation, in this way protecting the substrate.

By a film, surface, coating, or layer of codeposited catalytic metal and sacrificial metal is meant a film, surface, coating, or layer capable of having a porosity, after activation, that is high enough to provide a catalytic effect. This porosity is above about 15 percent, and preferably above about 35 percent.

The method herein described avoids the higher voltage and higher resistance heretofore associated with two separate plating baths, i.e., a first catalytic metal plating bath and a second plating bath of catalytic metal and a sacrificial metal, while retaining the higher catalyst adhesion associated with sequential electroplating of catalytic metal and catalytic metal with sacrificial metal.

The plating is carried out initially at a high temperature, believed to preferentially electrodeposit the catalytic metal, forming an electrolyte impermeable film, surface, or coating thereof on the substrate. Thereafter, using the same solution, i.e., without removing the cathode from the electroplating solution, the solution is cooled while continuing electroplating. The electroplating at the lower temperature may be carried out at a higher current density than the initial electroplating at the same current density as the initial electroplating, or even at a lower current density.

The first, elevated temperature is high enough to preferentially electrodeposit or electroplate catalytic metal, as described hereinabove, while the second, lower temperature is low enough to substantially coelectrodeposit or coelectrodeposit catalytic metal and sacrificial metal. The temperature difference between the first, elevated temperature and the second lower temperature should be such to result in an increase in the amount of sacrificial metal electrodeposited.

For an electroplating solution containing approximately 0.8 to 2.5 molar in catalytic metal and approximately 0.1 to 1.25 molar in sacrificial metal, the first temperature is above about 60 degrees Centigrade, and preferably above about 70 degrees Centigrade, and in a particularly preferred exemplification at least 90 degrees Centrigrade, whereby to provide a deposit that is substantially free of sacrificial metal.

The second, lower temperature is below 60 degrees Centigrade. and preferably below about 50 degrees Centigrade, and in particularly preferred exemplification be between about 40 degrees Centigrade to 50 degrees Centigrade, although temperatures of about 20 to 40 degrees Centigrade may be utilized.

The temperature difference, i.e., the difference between the initial, first, elevated temperature and the second, lower temperature, should be at least about 40 Centigrade degrees, that is, when the first, higher temperature is about 90 degrees Centigrade, the second, lower temperature should be below about 50 degrees Centigrade. It is particularly preferred that the temperature difference be at least about 50 Centigrade degrees, so that when the first temperature is about 90 degrees Centigrade the second temperature is about 40 degrees Centigrade, for electroplating solutions where the ratio of catalytic metal to sacrificial metal is from about 4:1 to about 8:1.

The duration of electrodeposition should be sufficient to provide coatings of the desired thickness. The time at the first, high temperature electrodeposition should be such as to deposit from about 10 to about 100 grams per square foot of catalytic material, i.e., to provide a coating of from about $1.5\times10^{-2}$ millimeters thick to about $1.5\times10^{-1}$ millimeters thick. At a deposition rate of 20 amperes per square foot, this is typically about 1 to 4 hours.

The current density at the first, high temperature should be low enough to favor the deposition of catalytic metal. The lower the current density is the lower the first, high temperature may be. Preferably, the current density at the first, higher temperature is below about 40 amperes per square foot, preferably below about 20 amperes per square foot. For example, nickel deposition, relative to zinc deposition, in nickel-zinc codeposition, is a stronger function of temperature than of current density, allowing current densities of above 140 to 150 amperes per square foot can be used at initial temperatures of above 80 to 90 degrees Centigrade without deleterious amounts of zinc being codeposited.

The time and current density of electrodeposition of the second, lower temperature should be such as to provide from 50 grams per square foot up to about 300 grams per square foot of total materials, providing a surface coating of up to about 0.3 millimeters thick. Preferably at least about 10 grams per square foot of materials are deposited to provide a thickness of at least about $1.5\times10^{-2}$ millimeters. The second, low temperature current density is preferably above about 20 amperes per square foot and in a particularly preferred exemplification above about 70 amperes per square foot. The total deposition at the second, low temperature is preferably above about 20 ampere hours per square foot and preferably above up to about 300 ampere hours per square foot.

The high current density utilized and the second, lower temperature favors deposition of sacrificial metal. The higher the current density, the higher the temperature that can be used for the co-deposition of sacrificial metal and catalytic metal. For example, at a current density of 72 amperes per square foot, satisfactory deposition of both materials takes place at 50 degrees Centigrade while at a current density of 20 amperes per square foot the deposition temperature should be below about 40 degrees Centigrade and preferably between about 30 to 40 degrees Centigrade.

Preferably the initial, high temperature electrodeposition of the catalytic metal is such as to get low levels of sacrificial metal, i.e., low enough to avoid porosity, e.g., less than about 1 weight percent by X-ray diffraction both at the substrate, and within about $1.5\times10^{-2}$ to $1.5\times10^{-1}$ millimeters thereof, and an increasingly greater amount of sacrificial metal at greater distances from the substrate.

Electrodeposition may be interrupted during cooling of the electroplating solution. In a preferred exemplification, there is no interruption of the electrodeposition during cooling of the electroplating solution. Electrodeposition may be started at a high temperature, continued at the high temperature, the electroplating solution cooled, and subsequently held at a low temperature, without interruption of electrodeposition. Alternatively, electrodeposition may be started at the first, higher temperature with slow cooling and increasing current density.

Various electroconductive substrates may be used as the cathode. The substrate may be foraminous or electrolyte impermeable. It may be in the form of plates, rods, sheets, screens, mesh, or gauze. The electroconductive substrate may be any material that is resistant to aqueous alkali metal hydroxides at the temperatures of electrolysis. Typical substrates include iron, cobalt, nickel, copper, chromium, mixtures thereof, alloys thereof, and graphite.

The coating is a catalytic metal and a sacrificial metal, leached to form a low hydrogen evolution overvoltage surface. By a catalytic metal is meant a metal having a lower hydrogen overvoltage than the substrate. The catalytic metal may be manganese, chromium, iron, cobalt, nickel, copper, ruthenium, rhodium, palladium, silver, osmium, iridium, platinum, combinations thereof or alloys thereof. Most commonly it is nickel.

The sacrificial metal, which is codeposited with the catalytic metal, may be aluminum, mangesium, gallium, tin, cadmium, bismuth, antimony, zinc, combinations thereof or alloys thereof. Most commonly it is zinc. While various sacrificial metals and catalytic metals are described herein, the sacrificial metals and catalytic metals must be adapted to each other, both for the electrodeposition process and for the method of removal of the sacrificial metal. Additionally, one or more of the sacrificial metals may be useful with one or more of the catalytic metals. A particularly preferred combination of catalytic metal and sacrificial metal is nickel and zinc.

The electroconductive substrate is preferably pretreated prior to electrodeposition. By pretreated is meant that the cathode substrate is sufficiently free from organic and inorganic films, for example oxides, to allow electroplating of a low overvoltage catalytic coating thereon, with a high level of adhesion and a low level of contact resistance. Pretreatment may be carried out by sandblasting, etching in strong acids, etching in strong bases, or rendering the electroconductive substrate anodic in a strong electrolyte.

After pretreatment of the substrate, the substrate is immersed in the electroplating solution. The electroplating solution may be a Watts bath, or solution of sulfates, chlorides, nitrates, phosphates, pyrophosphates, or organic salts, or combinations thereof. Preferably the electroplating solution is maintained at a pH of from about 1 to 7 and preferably from about 1.5 to 6 with 3 to 5 being particularly preferred. Additionally, there may be a buffer added thereto, for example boric acid. Alternatively or additionally aluminum chloride as a buffer and as an additional sacrificial metal. Similarly there may be organic materials as alcohols including polyhydric alcohols such as catechols and sugars.

The molar ratio of catalytic metal to sacrificial metal should be from about 2:1 to about 8:1, with from about 0.8 to about 2.5 moles per liter of catalytic metal preferably from about 1.0 to about 2.0 moles per liter of catalytic material, and from about 0.1 to about 1.25 moles per liter of sacrificial metal and preferably from about 0.2 to about 0.5 moles per liter of sacrificial metal.

Where the catalytic material is nickel and the sacrificial metal is zinc, the metals may be present in the solution as nickel chloride and zinc chloride, nickel sulfate and zinc sulfate; nickel sulfate and zinc chloride, nickel chloride and zinc sulfate; nickel sulfate and zinc chloride; nickel chloride and zinc sulfate; nickel chloride, nickel sulfate and zinc sulfate; nickel chloride, zinc chloride and zinc sulfate; nickel sulfate, zinc chloride and zinc sulfate; nickel chloride, zinc chloride and zinc sulfate; nickel chloride, nickel sulfate and zinc sulfate, nickel chloride, zinc chloride and zinc sulfate; nickel sulfate, zinc chloride and zinc sulfate, or various other combinations thereof such as pyrophosphates, nitrates, oxalates, and the like.

A particularly satisfactory electroplating solution is one containing from about 200 to about 300 grams per liter of nickel chloride, $NiCl_2.6H_2O$, from about 30 to about 50 grams per liter of zinc chloride, $ZnCl_2$, and sufficient acid to maintain the pH of from about 3 to about 5.

The opposite electrode, i.e., the plating anode may be soluble or insoluble. If soluble it may be used for electroplating of either catalytic material or sacrificial metal or both. Where the plating anode is an anode of the catalytic material, sacrificial material may be replenished by adding a salt or salts of the sacrificial metal to the electroplating bath. Where the anode is an anode of the sacrificial metal, the catalytic metal may be replenished by adding a salt or salts thereof to the bath. Where the electroplating anode is insoluble, both the catalytic metal and the sacrificial metal may be replenished by adding salts thereof to the electroplating bath. The anode may be an alloy of catalytic metal and sacrificial metal.

According to a preferred exemplification herein, the anode means may comprise two or more anode elements, at least one of the individual anodes being of the sacrificial metal and at least one of the individual anodes being of the catalytic metal. When anode means as described herein it utilized a power supply is connected to the cathode and to the anode means, i.e., to the anode of the sacrificial metal and the anode of the catalytic metal. Connection of the power supply to the anode means may be through a variable resistor whereby to control the the amperage of the sacrificial metal anode and the catalytic metal anode.

As herein contemplated, when anode means having two or more anodes are used, electroplating is commenced utilizing only the catalytic metal anode and as temperature is reduced increasing current is introduced to the soluble metal anode.

As herein contemplated, the cathode is activated by removal of the sacrificial metal. Activation may occur before installation of the diaphragm or permionic membrane, that is, after manufacturing of the cathode. Alternatively, activation may be simultaneous with installation of the diaphragm or permionic membrane, or even after installation in a cell, for example, before electrolysis or during the commencement and early stages of electrolysis.

Activation is preferably carried out with an aqueous alkali metal hydroxide, for example, a 5 to 40 weight percent solution of sodium hydroxide or a 7 to 60 weight percent solution of potassium hydroxide, at a temperature between the freezing and reflux temperatures of the solution, and preferably from about 20 to about 90 degrees Centigrade.

According to the method herein contemplated, a cathode may be prepared by sandblasting a 6 mesh to the inch by 6 mesh to the inch fingered, metal cathode. Thereafter, the sandblasted fingered metal cathode is degreased and immersed in a solution of an acid, such as inhibited HCl, or 1,1-dihydroxydiphosphonic acid, with the cathode being rendered cathodic for 10 minutes then anodic for 10 minutes. Thereafter the cathode is removed from the acid solution and inserted in an electroplating cell as the cathode thereof. The electroplating cell has an electroplating solution containing approximately 200 to 300 grams per liter of nickel chloride, $NiCl_2.6H_2O$ and about 30 to about 50 grams per liter of zinc chloride, with sufficient 1:1 hydrochloric acid to maintain the pH at between 3.0 and 5.0. The electroplating anode means are nickel strips and zinc strips, the nickel strips being connected to one side of the variable resistor and the zinc strips being connected to the opposite of the variable resistor. Initially the zinc strips are not immersed in the electroplating solution. The electroplating cell is heated to 90 degrees Centigrade and electroplating is commenced with substantially all of the electrical current passing from the nickel anodes to the cathode. Electroplating is carried out at a current density of from about 18 to about 50 amperes per square foot for 1 to 2 hours. Thereafter, without interrupting electrolysis or removing the cathode from the cell, the zinc strips are immersed in the solution and the solution is cooled over a period of about 10 to 40 minutes from 90 degrees Centigrade to about 40 degrees Centigrade, and current density is either maintained constant, or is increased linearly or stepwise from about 18 to 50 amperes per square foot to about 40 to 80 amperes per square foot with approximately 60 percent of the current being directed to the nickel anodes. After 150 ampere hours per square foot have been applied at temperatures below 50 degrees Centigrade, electroplating is stopped and the electroplated cathode is removed from the electroplating solution. The electroplated cathode is then inserted in 10 to 20 weight percent aqueous sodium hydroxide at a temperature of 50 to 60 degrees Centigrade for 4 hours, removed therefrom, rinsed with water, and an asbestos diaphragm deposited thereon. Thereafter an electrolytic cell is assembled utilizing the cathode and electrolysis is commenced.

The following Example is illustrative of the method of this invention:

EXAMPLE

An electrode was prepared by electrodeposition from a nickel-zinc electroplating bath, initially at 90 degrees Centigrade and thereafter at 40 degrees Centigrade. The electrode was then leached in aqueous sodium hydroxide, and utilized as a cathode in a laboratory electrolytic cell.

An electroplating solution was prepared containing:

| | |
|---|---|
| $NiCl_2 . 6H_2O$ | 251 grams/liter |
| $ZnCl_2$ | 43 grams/liter |
| HCl | to maintain pH 4.0–4.2 |

A one inch by one inch steel coupon was etched in 10 percent aqueous hydrochloric acid at 25 degrees Centigrade for several minutes, rinsed with distilled water, and immersed in the electroplating solution.

Utilizing a nickel anode, the coupon was rendered cathodic in the electroplating solution, at 90 degrees Centigrade, for two hours at 20 amperes per square foot. Without removing the cathode from the electroplating solution or interrupting electroplating, the solution was cooled to 40 degrees Centigrade, and a zinc anode was placed in the bath in parallel with the nickel anode. Electroplating was continued at 40 degrees Centigrade, at a current density of 40 amperes per square foot, for two hours.

The coupon, with a nickel and zinc coating, was then removed from the electroplating solution, and immersed in 10 weight percent aqueous sodium hydroxide at 90 degrees Centigrade for four hours.

The resulting cathode, having a porous nickel surface, was tested as a cathode in a laboratory cell. The cathode had a cathode potential of 1.13 volts versus a saturated silver-silver chloride reference electrode at a current density of 190 amperes per square foot.

While the invention has been described with respect to certain specific exemplifications and embodiments thereof, it is not intended to limit the scope of protection thereby, the scope of the invention being defined by the claims appended hereto.

I claim:

1. In a method of preparing a cathode comprising electrodepositing a catalytic metal and a sacrificial metal onto an electroconductive substrate by (a) inserting the electroconductive substrate into an electroplating solution containing cations of the catalytic metal, cations of the sacrificial metal, and a plating anode, and (b) passing an electrical current from the plating anode to the cathode whereby to electrodeposit metal on the electroconductive substrate; the improvement comprising commencing the electrodeposition at a first, elevated temperature whereby to preferentially electrodeposit catalytic metal onto the electroconductive substrate, cooling the electroplating solution, and thereafter continuing electroposition at a second, lower temperature whereby to codeposit catalytic metal and sacrificial metal.

2. The method of claim 1 wherein said first, elevated temperature is high enough to substantially avoid deposition of the sacrificial metal.

3. The method of claim 2 wherein the first, elevated temperature is above about 60 degrees Centigrade.

4. The method of claim 1 wherein said, lower temperature is low enough to deposit the sacrificial metal and the catalytic metal at substantially equal rates from the plating solution.

5. The method of claim 4 wherein said second, lower temperature is below about 60 degrees Centigrade.

6. The method of claim 1 wherein the catalytic metal is chosen from the group consisting of chromium, manganese, iron, cobalt, nickel, copper, molybdenum, ruthenium rhodium, palladium, osmium, iridium, platinum, and mixtures thereof.

7. The method of claim 6 wherein the catalytic metal is nickel.

8. The method of claim 1 wherein the sacrificial metal is chosen from the group consisting of aluminum, zinc, gallium, tin, lead, and mixtures thereof.

9. The method of claim 8 wherein the sacrificial metal is zinc.

10. The method of claim 1 comprising plating from a plating anode consisting essentially of catalytic metal at the first, higher temperature, and from plating anodes consisting essentially of catalytic metal and sacrificial metal at the second, lower temperature.

11. The method of claim 10 comprising plating from a first plating anode consisting essentially of sacrificial metal at the first, higher temperatures, and from a pair of second plating anodes at the second, lower temperature, one of said second plating anodes consisting essentially of the catalytic metal, and one of said second plating anodes consisting essentially of the sacrificial metal.

12. In a method of preparing a cathode comprising electrodepositing nickel and zinc onto an electroconductive substrate by (a) inserting the electroconductive substrate into an electroplating solution containing cations of nickel, cations of zinc, and a plating anode, and (b) passing an electrical current from the plating anode to the cathode whereby to electrodeposit metal on the electroconductive substrate; the improvement comprising commencing the electrodeposition at a first, elevated temperature whereby to preferentially electrodeposit nickel onto the electroconductive substrate, cooling the electroplating solution, and thereafter continuing electrodeposition at a second, lower temperature whereby to codeposit nickel and zinc.

13. The method of claim 12 wherein said first, elevated temperature is high enough to substantially avoid deposition of the zinc.

14. The method of claim 14 wherein the first, elevated temperature is above about 60 degrees Centigrade.

15. The method of claim 12 wherein said second lower temperature is low enough to codeposit nickel and zinc at substantially equal rates from the plating solution.

16. The method of claim 15 wherein said second, lower temperature is below about 60 degrees Centigrade.

17. The method of claim 12 comprising plating from a plating anode consisting essentially of nickel at the first, higher temperature, and thereafter from plating anodes consisting essentially of nickel and zinc at the second, lower temperature.

18. The method of claim 17 comprising plating from a plating anode consisting essentially of nickel at the first, higher temperature, and from a pair of second plating anodes at the second, lower temperature, one of said second plating anodes consisting essentially of nickel, and one of said second plating anodes consisting essentially of zinc.

19. A cathode comprising an electroconductive substrate, a substantially electrolyte impervious coating on said substrate, and a porous, catalytic coating on said electrolyte impervious coating, said electrode prepared by the method comprising:

(a) inserting the electroconductive substrate into an electroplating solution containing cations of a catalytic metal, cations of a sacrificial, and electroplating anode means;

(b) passing electrical current from the electroplating anode means to the cathode at an elevated temperature whereby to preferentially electrodeposit catalytic metal on the electroconductive substrate;

(c) cooling the electroplating solution;

(d) thereafter passing an electrical current from the electroplating anode means to the cathode at a second, lower temperature, whereby to codeposit catalytic metal and sacrificial metal onto the cathode; and (e) thereafter contacting the cathode with a leachant to remove sacrificial metal therefrom.

20. The electrode of claim 19 wherein said first, elevated temperature is high enough to substantially avoid deposition of the sacrificial metal.

21. The electrode of claim 20 wherein the first, higher temperature is above about 60 degrees Centigrade.

22. The electrode of claim 19 wherein said, lower temperature is low enough to deposit the sacrificial metal and the catalytic metal at substantially equal rates from the plating solution.

23. The electrode of claim 22 wherein said second, lower temperature is below about 60 degrees Centigrade.

24. The electrode of claim 19 wherein the catalytic metal is chosen from the group consisting of chromium, manganese, iron, cobalt, nickel, copper, molybdenum, ruthernium, rhodium, palladium, osmium, iridium, platinum and mixtures thereof.

25. The electrode of claim 24 wherein the catalytic metal is nickel.

26. The electrode of claim 19 wherein the sacrificial metal is chosen from the group consisting of aluminum, zinc, gallium, tin, lead, and mixtures thereof.

27. The electrode of claim 26 wherein the sacrificial metal is zinc.

28. The electrode of claim 19 wherein the electroconductive substrate is chosen from the group consisting of iron, copper, nickel, mixtures and alloys thereof, and graphite.

* * * * *

UNITED STATES PATENT AND TRADEMARK OFFICE

CERTIFICATE OF CORRECTION

PATENT NO. : 4,331,517

DATED : May 25, 1982

INVENTOR(S) : Thomas A. Rechlicz

It is certified that error appears in the above-identified patent and that said Letters Patent are hereby corrected as shown below:

In Claim 1, column 8, line 31, "electroposition" should read --electrodeposition--.

In Claim 14, column 9, line 23, "14" should read --13--.

In Claim 24, column 10, line 34, "ruthernium" should read --ruthnium--.

Signed and Sealed this

*Twenty-fourth* Day of *August 1982*

[SEAL]

*Attest:*

GERALD J. MOSSINGHOFF

*Attesting Officer*

*Commissioner of Patents and Trademarks*